United States Patent [19]

Houser

[11] Patent Number: 4,809,396

[45] Date of Patent: Mar. 7, 1989

[54] COMBINATION VACUUM AND SOLUTION-DISPENSING APPARATUS

[76] Inventor: Franklin C. Houser, 15520 Donmetz St., Mission Hills, Calif. 91345

[21] Appl. No.: 67,374

[22] Filed: Jun. 29, 1987

[51] Int. Cl.[4] ..... A47K 7/00

[52] U.S. Cl. ..... 15/320; 15/353; 15/401

[58] Field of Search ..... 15/320, 353, 352, 401

[56] References Cited

U.S. PATENT DOCUMENTS

| | | | |
|---|---|---|---|
| 1,572,913 | 2/1926 | Finnell | 15/401 X |
| 2,292,435 | 8/1942 | Crites | 15/401 X |
| 2,533,395 | 12/1950 | Paine | 15/353 X |
| 2,909,800 | 10/1959 | Grindle et al. | 15/353 X |
| 2,989,769 | 6/1961 | Houser | 15/353 |
| 3,165,774 | 1/1965 | Barba | 15/353 X |
| 3,408,673 | 11/1968 | Oxel | 15/320 X |
| 3,431,582 | 3/1969 | Grave | 15/353 X |
| 4,170,805 | 10/1979 | Kumagai | 15/353 X |
| 4,171,208 | 10/1979 | Lowder | 15/353 X |
| 4,542,556 | 9/1985 | Hepple | 15/353 X |
| 4,616,378 | 10/1986 | Berfield et al. | 15/353 |

FOREIGN PATENT DOCUMENTS

| | | | |
|---|---|---|---|
| 1801921 | 5/1969 | German Democratic Rep. | 15/353 |

*Primary Examiner*—Chris K. Moore

*Attorney, Agent, or Firm*—Francis X. LoJacono

[57] ABSTRACT

A combination vacuum and liquid-dispensing apparatus provided in modular form and having several modes of operation for specific applications such as solution dispensing, spraying, and washing, as well as carpet and upholstery cleaning, wherein the apparatus includes a storage tank mounted to a base structure having a plurality of caster wheels, a vacuum motor located within the cover of the tank, and a one-way-valve unit interposed between the vacuum motor and the tank. To provide a spraying operation, there is included a pump which is adapted to be employed with an adjustable squeegee pick-up head which is mounted to the front of the tank along with a pair of bumpers. The present invention is readily adaptable for use with liquid applicators and vacuum tools by connecting the proper tool to the respective vacuum system or pump system.

7 Claims, 4 Drawing Sheets

COMBINATION VACUUM AND SOLUTION-DISPENSING APPARATUS

BACKGROUND OF THE INVENTION

This invention relates generally to an apparatus used as a vacuum and solution-dispensing device for cleaning applications, and more particularly to an apparatus of this type which combines a vacuum cleaner with a device for dispensing a cleaning solution, the apparatus also including interchangeable components to provide a variety of cleaning, scrubbing and vacuuming operations so as to establish a compact modular unit which has not been found heretofore in the art.

Various problems and difficulties are being encountered in providing suitable modular devices that are compatible for use in a wide range of janitorial applications including cleaning, rinsing and waxing operations for walls, floors, carpets, etc.

Many of the known janitorial devices employed for cleaning, waxing and scrubbing large floor areas, particularly those in buildings such as food markets, warehouses and offices, require a multiplicity of units, each having its own special cleaning, waxing or scrubbing capabilities. Hence, an investment in several machines is required to be able to meet the various cleaning demands of a janitorial business. Therefore, there is inherently created a very costly and time-consuming operation. Also, in most cases, a janitorial service must operate within a limited time frame, since the majority of the work must be scheduled during off hours when there is little or no building traffic.

SUMMARY AND OBJECTS OF THE INVENTION

Thus, it is an important object of the present invention to provide a unique combination vacuum and dispensing apparatus that solves the many existing problems in the janitorial industry today.

In accordance with one of the embodiments of this invention, there is provided a combination vacuum and liquid-dispensing apparatus that includes a tank assembly having a removable cover mounted to a wheeled base, the tank being capable of holding and storing various types of solutions such as water, solvents, soaps, waxes, and other required cleaning materials. The tank includes a gravity-feed, liquid-dispensing duct having a gate valve to control dispensing of liquid through a rearwardly positioned liquid applicator. Solution is dispensed by raising the gate valve to provide a desired flow and spread of solution over a given area.

A second embodiment of the invention includes a suitable high-pressure pump mounted to the handle assembly of the tank unit, the pump being adapted for connection to a suitable electrical outlet and controlled by a manually operated switch means. A receptacle for operating with other power sources is also encased within the pump housing. The pump further includes an inlet port and an outlet port, the inlet port being interconnected by a hose to the storage tank so as to receive fluid therefrom as required. A quick-disconnect means is included in the outlet port, allowing a pressure hose to be attached thereto. There allows a hose for solutions to be installed and used with the various selective applicator tools, such as sprayers, scrubbers, and carpet and upholstery soil extractors.

A third arrangement of the present invention includes all the functions and components of the first two embodiments with the additional components and features as follows.

The tank cover is provided with a two-stage bypass vacuum motor mounted to a mounting plate and removably attached to the storage tank. An intake connector is also mounted to the mounting plate for attaching various types of vacuum hoses such as for interconnecting the tank to a squeegee attachment mounted at the lower front of the tank-base member. Or a vacuum hose may be used to connect a conventional wand and squeegee tool, carpet tool or any other suitable tool or device employed with vacuums.

Attached to the underside of the mounting plate is a float-valve device that shuts off the vacuum motor as the tank fills with solution. At a given point, a ball which is movably disposed within a plastic housing floats up to the aligned opening formed in the mounting plate and thus shuts off the vacuum suction to protect the vacuum motor. Interposed between the ball of the valve and the vacuum opening is a filter of a suitable type to capture debris, if present, within the tank.

The squeegee mounted to the front of the tank-support base includes two angle brackets that attach the squeegee to the base member with two bolts threaded to the squeegee. These bolts are adjustable for raising or lowering the squeegee head. Also attached to these bolts are two roller bumpers positioned to protect the squeegee attachment.

The tank assembly operates on four or six swivel stem casters which attach to the underside of the base. When six casters are employed, the two centrally positioned ones extend a quarter of an inch below the front and rear casters to provide a tilt action for engaging the squeegee or maneuvering the machine to other locations.

It is, therefore, an object of this invention to provide an apparatus of this type that defines a modular concept of high performance heretofore not provided in the art.

A further object of the invention is to provide an apparatus of this character that allows a multiplicity of janitorial functions with relatively few operating parts.

Still another object of the invention is to provide a device of this character that is simple and rugged in construction and is easy to service and maintain.

The various features of novelty which characterize the invention are pointed out with particularity in the claims annexed to and forming a part of this disclosure. For a better understanding of the invention, its operating advantages by its use, reference should be had to the accompanying drawings and descriptive matter in which there are illustrated and described the preferred embodiments of the invention.

BRIEF DESCRIPTION OF THE DRAWINGS

Referring more particularly to the accompanying drawings, which are for illustrative purposes only.

DESCRIPTION OF THE PREFERRED EMBODIMENTS

Figure 1:
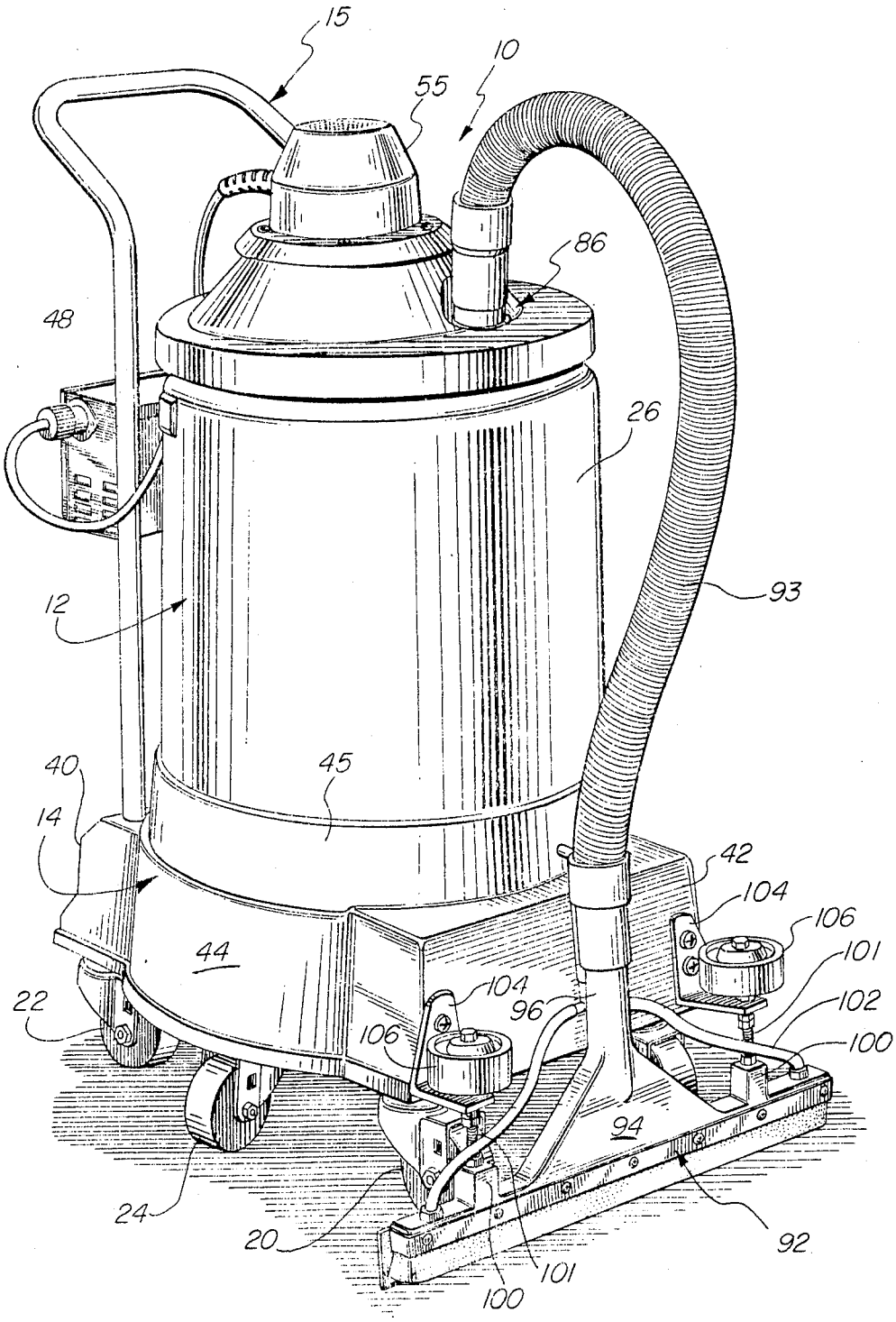
FIG. 1 is a perspective view of one embodiment of the invention.
Figure 2:
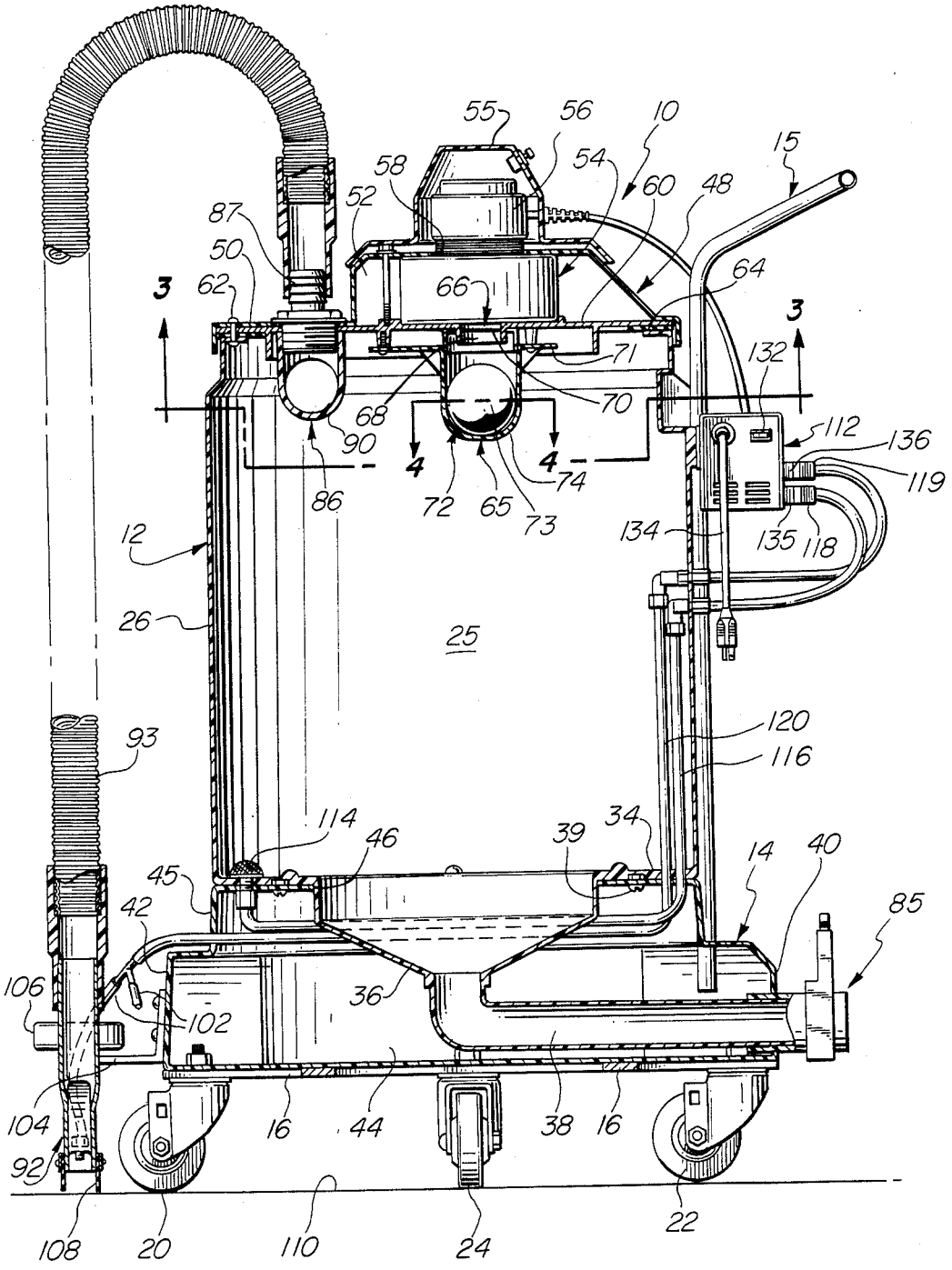
FIG. 2 is a vertical cross-section of the invention as shown in FIG. 1.

Referring more particularly to FIGS. 1 and 2, there is shown a combination vacuum and liquid-dispensing apparatus, generally indicated at 10, which is designed to operate as a single unit or as a combination of units having various individual as well as cooperating operations.

The present invention comprises a fluid-storage tank 12 which is positioned on and mounted to a base structure, designated at 14, with handle means 15 mounted thereto. The base structure 14 includes a support frame 16 secured to the underside or bottom wall 18 of the base structure, as shown in FIG. 2. Attached to support frame 16 are a plurality of swivel stem casters, more specifically as indicated in the drawings the casters including a front pair of casters 20, a rear pair of casters 22, and an intermediate pair of casters 24.

Figure 8:
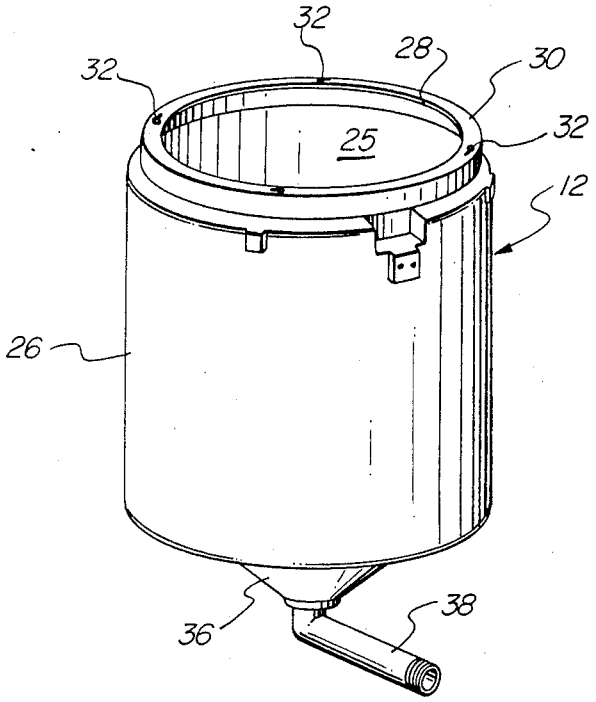
FIG. 8 is a perspective view of the fluid-storage tank.
Figure 9:
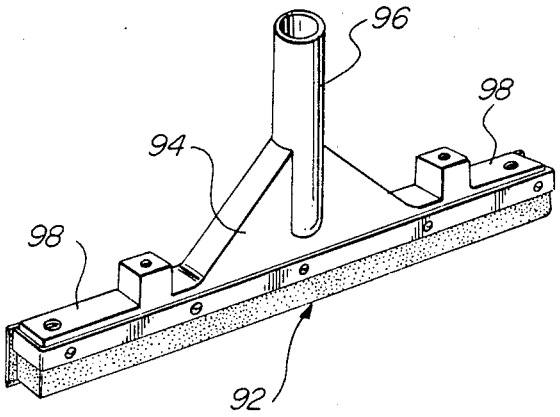
FIG. 9 is a perspective view of the squeegee pick-up head.

Referring more particularly to the structure of storage tank 12, there is defined a shell-like tub 25 having an annular wall 26. (See FIG. 8.) The upper end of tub 24 is further defined by an opening 28 formed by an inwardly extended annular flange member 30 that includes a plurality of slotted holes 32. The lower end of the tub is formed with a bottom wall 34 which itself includes a drain chute 36 and a drain or outlet duct 38.

Accordingly, tank 12 is secured to base structure 14 by suitable securing means, such as screws 39, the outlet duct 38 being positioned to extend rearwardly and outwardly of the rear wall 49 of base 14. Base structure 14 is also formed with a front wall 42, side walls 44, and an upwardly projecting, annular mounting platform 45 which is adapted with a central opening 46 in which is positioned chute 38 of tub 25, as readily seen in FIG. 2.

Figure 3:
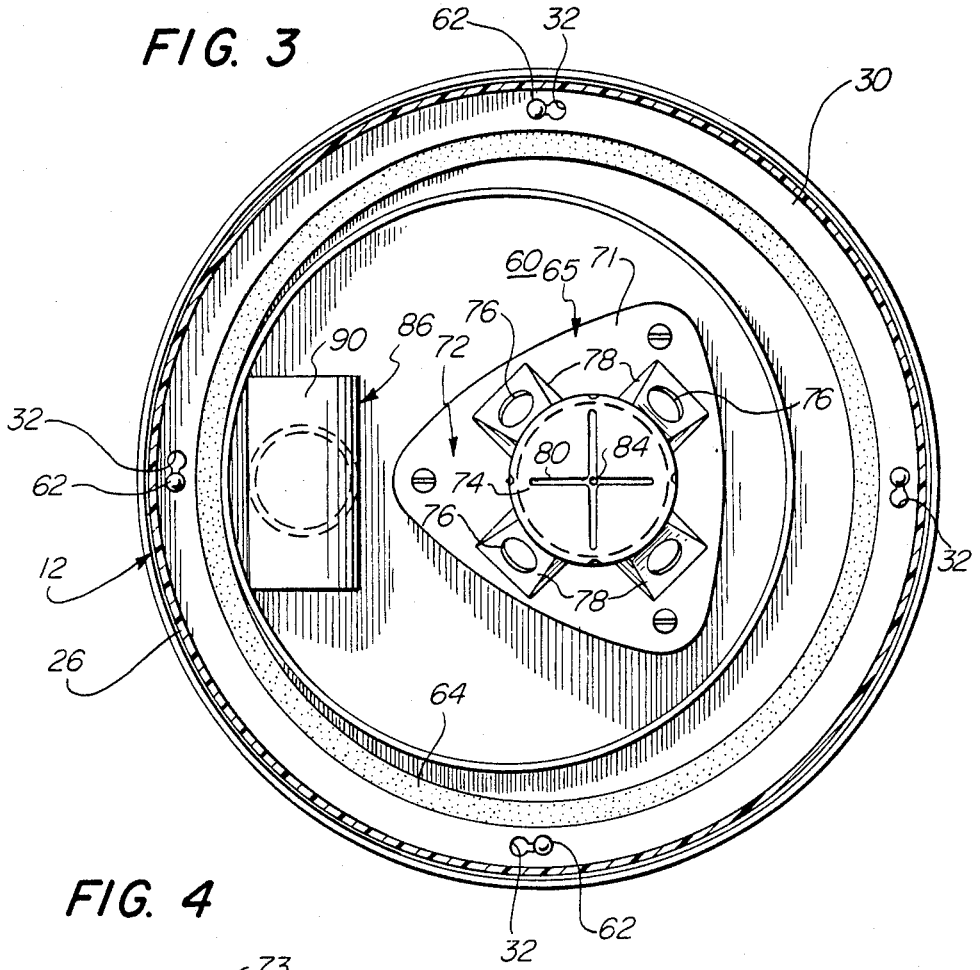
FIG. 3 is a cross-sectional view taken substantially along line 3—3 of FIG. 2.
Figure 4:
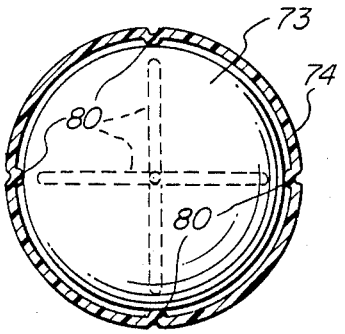
FIG. 4 is an enlarged cross-sectional view of the ball valve taken substantially along line 4—4 of FIG. 2.

A cover means, generally designated at 48, is provided to cover opening 28 of tub 25. The cover means comprises a cover plate 50 having a substantially centrally positioned compartment 52 in which a vacuum-motor means, designated at 54 is enclosed, a portion of the vacuum motor being covered by a protective cap 55 as motor 56 extends through cover opening 58. Both the cover 48 and vacuum motor 54 are secured and mounted to a base plate 50. The entire cover assembly is removably attached to the top of tank 12 by means of slots 32 formed in tank flange 30 and pins 62, as seen in FIGS. 2 and 3. A sealing ring 64 is interposed between base plate 60 and flange 30.

Attached to the bottom of base plate 60 is a one-way valve means, designated generally at 65, which is centrally positioned under vacuum motor 54 and communicates therewith by means of aperture 66 defined by a depending flange 68 formed as a part of base plate 60. Flange 68 provides two functions, one as a valve seat and the other as a means to attach a filter screen 70 which prevents foreign matter from entering vacuum-motor means 54.

Figure 5:
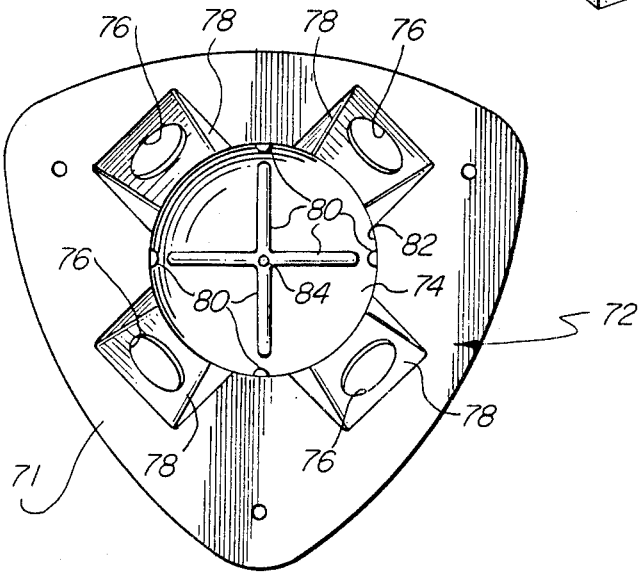
FIG. 5 is an enlarged top-plan view of the ball-valve housing.

Valve means 65 comprises a valve housing 72, illustrated in FIGS. 2, 3 and 5, including an enlarged ball 73 adapted to rest in the bottom of housing well 74 until fluid fills tub 25 to a level high enough to enter opening 76 disposed in each of the side-projecting walls 78 of valve housing 72. To provide free vertical floating movement of ball 73, a plurality of guide rib members 89 are formed on the inner surface of wall 82. Fluid is also allowed to enter well 74 through hole 84 located in the bottom of the well.

To establish a closed end tank, outlet duct 38 is provided at its free end with a slide valve, indicated at 85. This valve is kept closed during various operations such as a vacuum mode or a pumping mode. Hence, during a fluid-vacuum mode of operation, fluid is sucked through an inlet adapter 86 attached to cover 48 and its base plate 60. (See FIG. 2.) Inlet adapter 86 is shown comprising a hose connector 87 which extends outwardly from cover 48 and is secured to a "T" outlet duct 90. Fluid enters tub 25 through outlet duct 90, thus filling the tub until fluid rises to cause ball 73 to float upwardly to engage valve seat 68, thereby closing off flow to the vacuum motor. Valve housing 72 includes a peripheral flange 71 adapted to be mounted to the underside of base plate 60.

Inlet adapter 86 is arranged to have various pieces of vacuum equipment connected thereto. As one example, when a large open floor area is covered with a solution that requires removal thereof, a vacuum device is employed that comprises a squeegee pick-up head 92 attached to the front of base structure 14, as illustrated in FIGS. 1 and 2, and a flexible hose 93 connected between adapter 86 and squeegee 92. Squeegee pick-up head 92 is formed with a housing 94 which includes a neck member 96 adapted to be connected to one end of hose 93, and laterally extended arms 98. The arms are formed with a mounting block 100 adapted to receive adjustable mounting bolts 101, each arm including threaded bores whereby spray hoses 102 are connected to the squeegee. Mounting bolts 101 are adjustably attached to aligned angle brackets 104 which are affixed to the front wall 42 of base structure 14. These bolts 101 are adjustable for raising and lowering the squeegee housing. Also attached to bolts 101 are roller bumpers 106. It should be noted that the tank assembly operates on all six casters, the centrally disposed pair of casters 24 extending downwardly approximately one-quarter inch below the front and rear pairs of casters 20 and 22, respectively. This arrangement allows a tilt action so as to engage the squeegee or maneuver the machine to other locations. FIG. 2 shows the machine tilted forwardly whereby the squeegee blade 108 engages floor 110.

During a rinsing operation, solution from tub 25 is pumped by means of pump 112 mounted to the rear of tank 12. That is, solution from tub 25 is pumped through a screened outlet plug 114 which is connected to pump 112 by hose 116, the pump and hose being connected by a quick-disconnect means 118. The solution is then pumped through line 120 to lines 102 and then sprayed onto floor 110 as a rinse, and simultaneously sucked back through squeegee head 92 which returns the rinse solution back to the tub of tank 12.

Figure 6:
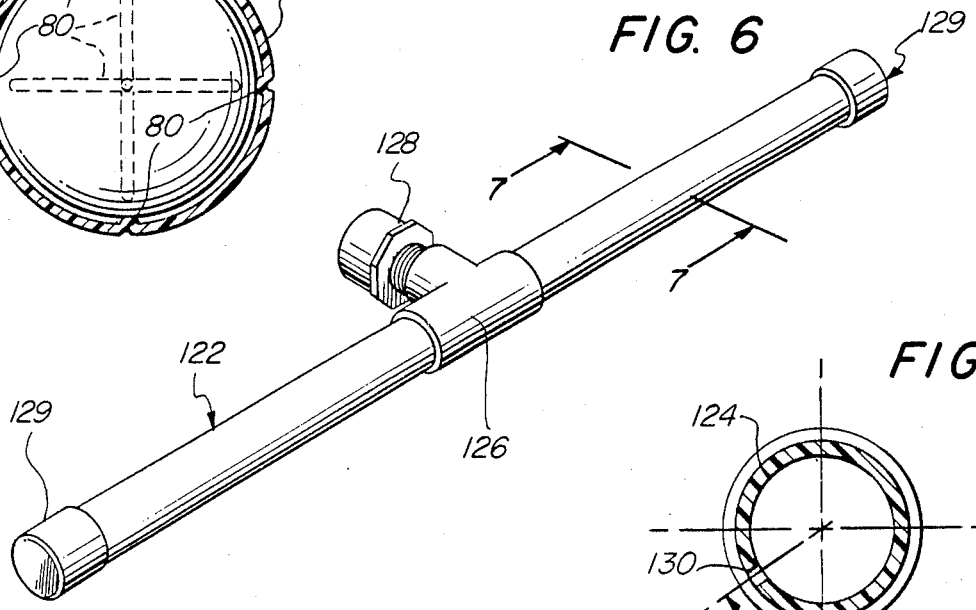
FIG. 6 is a perspective view of a solution-dispensing applicator unit.
Figure 7:
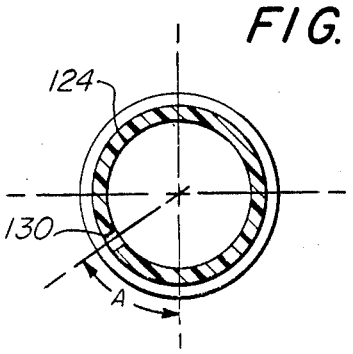
FIG. 7 is an enlarged cross-sectional view taken along line 7—7 of FIG. 6.

It should be noted at this time that other equipment and tools may be attached to the machine. That is, when the invention is employed as a water dropper, the tank 12 is filled with water which is discharged through rearwardly extending pipe 38, the free end of which may be provided with a dispensing applicator 122, as seen in FIG. 6 and 7. The dispensing applicator comprises an elongated pipe member 124 formed preferably from a twenty-inch long P.V.C. pipe. Pipe 124 includes a "T" joint 126 which is provided with a nipple member 128, and oppositely disposed cap members 129. The free end of outlet duct 38 is adapted to receive nipple member 128 whereby the plurality of dispensing holes 130 disposed longitudinally along dispensing pipe 124 are positioned downwardly and forwardly. That is, holes 130 are positioned at approximately 20° to 25° but preferably at 22½°, as seen in FIG. 7 at "A". This particular arrangement of holes 130 provides for the most complete and even coverage of solution as it is discharged over the floor area. Accordingly, vacuum motor 56 and pump means 112 are not employed in this mode of operation. As an alternative, a spigot (not shown) may be used instead of dispensing pipe 124 whereby a variety of applicators can be attached.

A second mode of operation includes the use of pump means 112 (100 p.s.i. diaphragm pump) having a switch 132 and electric cord 134. Pump 112 is provided with an inlet 135 and an outlet 136, each having respective quick-disconnect means 118 and 119. Thus, other equipment can be readily attached to disconnect member 119, such as a spray hand tool, scrub hand tool, carpet extractor, and upholstery tool.

A third mode of of operation includes the use of a bypass vacuum motor, indicated at 56, mounted to base plate 60 and encased in a housing cover 48. Vacuum hose 93 is attached to the intake of tank 12 and is generally attached to squeegee 92 in front of the tank. A similar hose may be employed for connection to a conventional wand and squeegee tool, a carpet tool or any other type of tool that is compatible for use with vacuums.

A fourth mode is shown in FIG. 2 wherein the squeegee head is connected to pump 112 whereby solution from the tub can be pumped, either when the vacuum is in operation or not in use.

The foregoing is a description of the preferred embodiments of the invention which are given here by way of example only. The invention is not to be taken as limited to any of the specific features as described, but comprehends all such variations thereof as come within the scope of the appended claims.

I claim:

1. An apparatus for storing and dispensing fluids under controlled conditions, comprising:

a tank for receiving and/or storing fluids;

a base structure on which said tank is mounted;

a plurality of caster wheels mounted to said base member whereby said apparatus may be moved from place to place;

said tank including an upper open end defined by a continuous side wall having a bottom wall;

said bottom wall being formed with a centrally disposed drain chute integrally formed with an outlet duct which extends rearwardly of said base structure;

a discharge-valve means mounted to the free end of said outlet duct;

a dispensing applicator to be removably attached to one end of said discharge-valve means;

wherein said dispensing applicator comprises:

an elongated pipe having the opposite ends thereof closed;

a "T" joint member interposed between said closed ends of said pipe;

a plurality of dispensing holes disposed longitudinally along said pipe whereby fluid is discharged evenly over the floor area when said discharge-valve means is opened.

2. An apparatus as recited in claim 1, wherein said holes are aligned and angularly disposed in a downward and forward direction with respect to the vertical center line of said pipe.

3. An apparatus as recited in claim 2, wherein the angular displacement of said holes is between 20° to 25°.

4. An apparatus as recited in claim 2, wherein the angular displacement of said holes is 22½°.

5. A vacuum cleaner and liquid-dispensing apparatus comprising:

a tank formed having a continuous side wall, a bottom wall, and an upper opening defined by an annular flange member;

a base structure on which said tank is mounted;

a plurality of caster wheels mounted to said base member whereby said apparatus may be moved from place to place during operation of said apparatus;

a cover means removably attachable to said annular flange of said tank;

said cover means including a base plate;

a motor driven suction fan mounted to the upper surface of said base plate so as to communicate with the interior of said tank;

a one-way-valve means mounted to the underside of said base plate to close communication between said motor driven suction fan and said tank, said valve means being controlled by the amount of fluid in said tank;

a vacuum-inlet means mounted in said base plate; and a vacuum tool means removably attachable to said vacuum inlet means;

wherein said vacuum-tool means comprises;

a squeegee pick-up head adjustably attached to the front of said base structure;

a flexible hose connecting said squeegee pick-up head to said vacuum-inlet means whereby fluid is vacuumed into said tank;

means for adjusting said squeegee pick-up head with respect to a floor surface;

wherein said squeegee pick-up head comprises a housing having laterally extending arm members and upwardly projecting neck members, and wherein said arm members include means to attach said flexible hose; and bumper means mounted to said mounting brackets.

6. A vacuum cleaner and liquid-dispensing apparatus comprising:

a tank formed having a continuous side wall, a bottom wall, and an upper opening defined by an annular flange member;

a base structure on which said tank is mounted;

a plurality of caster wheels mounted to said base member whereby said apparatus may be moved from place to place during operation of said apparatus;

a cover means removably attachable to said annular flange of said tank;

said cover means including a base plate;

a motor driven suction fan mounted to the upper surface of said base plate so as to communicate with the interior of said tank;

a one-way-valve means mounted to the underside of said base plate to close communication between said motor driven suction fan and said tank, said valve means being controlled by the amount of fluid in said tank;

a vacuum-inlet means mounted in said base plate; and a vacuum-tool means removably attachable to said vacuum-inlet means;

wherein said vacuum-tool means comprises:

a squeegee pick-up head adjustably attached to the front of said base structure;

a flexible hose connecting said squeegee pick-up head to said vacuum-inlet means wherein fluid is vacuumed into said tank;

means for adjusting said squeegee pick-up head with respect to a floor surface;

wherein said squeegee pick-up head comprises a housing having laterally extending arm members and upwardly projecting neck members, and wherein said arm members include means to attach said flexible hose; and a hose line connected from said outlet connection of said pump to said squeegee pick-up head whereby fluid is pumped and sprayed within said housing so as to be deposited on the floor surface during the operation of said apparatus.

7. An apparatus as recited in claim 5, wherein said one-way-valve means comprises:

a valve housing attached to the underside of said base plate in alignment with said motor driven suction fan;

said housing being formed with a plurality of openings to allow fluid to enter said housing;

a plurality of rib members formed on the inner wall of said housing;

a ball-valve member floatably supported in said housing by means of said rib members; and a valve seat formed on said base plate for engagement with said ball-valve member as fluid enters said openings and said ball-valve member floats upwardly for engagement therewith.

* * * * *